US008807742B2

(12) United States Patent
Tsuzawa

(10) Patent No.: US 8,807,742 B2
(45) Date of Patent: Aug. 19, 2014

(54) IMAGE FORMING DEVICE AND IMAGE FORMING METHOD

(75) Inventor: Yoshiyuki Tsuzawa, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 144 days.

(21) Appl. No.: 13/531,607

(22) Filed: Jun. 25, 2012

(65) Prior Publication Data

US 2013/0021402 A1 Jan. 24, 2013

(30) Foreign Application Priority Data

Jul. 22, 2011 (JP) ..... 2011-161001

(51) Int. Cl.
*B41J 2/205* (2006.01)
*B41J 11/00* (2006.01)
*B41J 13/22* (2006.01)

(52) U.S. Cl.
CPC ..... *B41J 11/002* (2013.01); *B41J 13/223* (2013.01)
USPC ..... 347/105; 347/16

(58) Field of Classification Search
None
See application file for complete search history.

(56) References Cited

U.S. PATENT DOCUMENTS 8,328,320 B2 * 12/2012 Nakata ..... 347/16
8,465,147 B2 * 6/2013 Tanahashi ..... 347/104
8,690,276 B2 * 4/2014 Moore ..... 347/8

FOREIGN PATENT DOCUMENTS

JP 2008-015609 A 1/2008

* cited by examiner

*Primary Examiner* — Lamson Nguyen
(74) *Attorney, Agent, or Firm* — SOLARIS Intellectual Property Group PLLC

(57) ABSTRACT

An inkjet recording device has: an image drawing drum that holds and conveys plural sheets at plural different holding surfaces respectively; and inkjet heads that are provided so as to face the image drawing drum and form an image on a surface of a sheet that is held on the image drawing drum. A control device has plural conveying modes that are set such that sheets are thinned-conveyed to a predetermined holding surface, without using all of the plural holding surfaces of the image drawing drum. The control device selects any one of the plural conveying modes on the basis of a number of sheets processed per unit time.

10 Claims, 9 Drawing Sheets

FIG.4

| CONVEYING PATTERN No. | A | B | A | B | A | B | A | B | A | B | A | B | | A | B | A | B | A | B | A | B | A | B | A | B | COOLING TIME | NUMBER OF SHEETS OF JOB | | PRODUCEABILITY |
|---|---|---|---|---|---|---|---|---|---|---|---|---|---|---|---|---|---|---|---|---|---|---|---|---|---|---|---|---|---|
| 1 | O | O | O | O | O | O | O | O | O | O | O | O | | O | O | O | O | O | O | O | O | O | O | O | O | 20 MIN | DEFINED AS 1 | 1000 SHEETS / 40 MIN | 25 |
| | | | | | | | | | | | | | | | | | | | | | | | | | | | | | |
| 2 | O | | | O | | | O | | | O | | | | O | | | O | | | O | | | O | | | 47 MIN | =1/3 | 333 SHEETS / (20+47) MIN | 4.9701 |
| | | | | | | | | | | | | | | | | | | | | | | | | | | | | | |
| 3 | O | | O | | O | | O | | O | | O | | | O | | O | | O | | O | | O | | O | | 60 MIN | =1/2 | 500 SHEETS / (20+60) MIN | 6.25 |
| CONVEYING MODE II | | | | | | | | | | | | | | | | | | | | | | | | | | | | | |
| 4 | O | | O | | O | | O | | O | | O | | 5 MIN | | O | | O | | O | | O | | O | | O | 40 MIN | =1/2 | 500 SHEETS / (40+20+5) MIN | 7.6923 |
| CONVEYING MODE I | 500 SHEETS = 10 MIN | | | | | | | | | | | | | 500 SHEETS = 10 MIN | | | | | | | | | | | | | | | |

FIG.5

| CONVEYING PATTERN No. | A | B | A | B | A | B | A | B | A | B | A | B | A | B | A | B | A | B | A | B | A | B | A | B | COOLING TIME | NUMBER OF SHEETS OF JOB | PRODUCEABILITY |
|---|---|---|---|---|---|---|---|---|---|---|---|---|---|---|---|---|---|---|---|---|---|---|---|---|---|---|---|
| 1 | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 4 MIN | DEFINED AS 1 | 200 SHEETS / (4+4) MIN |
| | | | | | | | | | | | | | | | | | | | | | | | | | | | |
| 2 | ○ | | | ○ | | ○ | | ○ | | ○ | | ○ | | ○ | | ○ | | ○ | | ○ | | ○ | | | 9.4 MIN | =1/3 | 67 SHEETS / (4+9.4) MIN |
| | | | | | | | | | | | | | | | | | | | | | | | | | | | |
| 3 | ○ | | ○ | | ○ | | ○ | | ○ | | ○ | | ○ | | ○ | | ○ | | ○ | | ○ | | ○ | | 12 MIN | =1/2 | 100 SHEETS / (4+12) MIN |
| | | | | | | | | | | | | | | | | | | | | | | | | | | | |
| 4 | ○ | | ○ | | ○ | | ○ | | ○ | | ○ | | ○ | | ○ | | ○ | | ○ | | ○ | | ○ | | 8 MIN | =1/2 | 100 SHEETS / (4+8+5) MIN |

CONVEYING MODE II

CONVEYING MODE I

100 SHEETS = 2 MIN

5 MIN

100 SHEETS = 2 MIN

PRODUCEABILITY: 25 / 5 / 6.25 / 5.8824

IMAGE FORMING DEVICE AND IMAGE FORMING METHOD

CROSS-REFERENCE TO RELATED APPLICATION

This application claims priority under 35 USC 119 from Japanese Patent Application No. 2011-161001, filed on Jul. 22, 2011, the disclosure of which is incorporated by reference herein.

BACKGROUND OF THE INVENTION

1. Field of the Invention

The present invention relates to an image forming device and an image forming method.

2. Description of the Related Art

Japanese Patent Application Laid-Open (JP-A) No. 2008-15609 discloses a continuous paper printing device having an input buffer that buffers print data, and an output buffer that outputs image data on the basis of print data supplied from the input buffer. The device also has printing means that carries out printing on a continuous paper on the basis of the data of the output buffer, and means for judging whether or not image data will be generated in time for the printing time.

This continuous paper printing device is structured such that, when it is judged that image data will not be generated in time for the printing time, a predetermined number of skipped pages (areas where there are no images) are inserted between pages that are printed on the basis of the generated data.

However, the device disclosed in JP-A No. 2008-15609 is the structure of a continuous paper printing device, and, when applied to, for example, an impression cylinder conveying type image forming device that forms an image while holding and conveying two sheets (cut papers) at an impression cylinder that rotates, a blank sheet is inserted between sheets on which images are formed, and the post-processing is difficult.

SUMMARY OF THE INVENTION

In view of the above-described circumstances, the present invention provides an image forming device and an image forming method that can handle cases in which the image processing speed does not keep up with the processing speed of the device (device speed), even in cases in which cut sheets are used.

An image forming device of first aspect of the present invention has: a conveying body that holds and conveys plural recording media at different holding regions of a peripheral surface of the conveying body respectively; an image forming section that is provided so as to face the conveying body, and that forms images on surfaces of the recording media that are held at the conveying body; and a control device that has plural conveying modes that are set such that the recording media are thinned-conveyed to a predetermined holding region without using all of the holding regions of the peripheral surface of the conveying body.

Namely, the image forming device has a conveying body that can hold and convey plural recording media at plural different holding regions of a peripheral surface of the conveying body respectively; an image forming section that is provided so as to face the conveying body, and that forms images on surfaces of the recording media that are held at the conveying body; and a control device that has plural conveying modes that are set so as to carry out thinned-conveying in which the recording media are held and conveyed at only a predetermined holding region among the plural different holding regions of the peripheral surface of the conveying body, without using all of the holding regions.

In accordance with the above-described invention, plural recording media are held and conveyed on different holding regions of the peripheral surface of the conveying body respectively, and images are formed on the surfaces of the recording media, that are held on the conveying body, by the image forming section that is provided so as to face the conveying body. The image forming device has the control device that has plural conveying modes that are set such that, at this time, the recording media are thinned-conveyed to a predetermined holding region, without using all of the holding regions of the peripheral surface of the conveying body. By executing any one of the plural conveying modes, a case in which the image processing speed does not keep up with the processing speed of the device (the device speed) can be handled.

In an image forming device of a second aspect of the present invention, in the image forming device of the first aspect, the control device selects any one of the plural conveying modes by using, as a reference, a number of recording media processed per unit time that is computed from a product of a number of recording media to be printed of a job to be executed and a unit printing time, and a time required when switching the holding region on which the recording media are conveyed of the peripheral surface of the conveying body during the job, and a time over which the conveying body, whose temperature has risen, is cooled after completion of the job.

In accordance with the above-described aspect, the control device selects any one of the plural conveying modes by using, as a reference, the number of recording media processed per unit time that is computed from the product of the number of recording media to be printed of the job to be executed and the unit printing time, and the time required when switching the holding region on which the recording media are conveyed of the peripheral surface of the conveying body during the job, and the time over which the conveying body, whose temperature has risen, is cooled after completion of the job. Due thereto, a case in which the image processing speed does not keep up with the processing speed of the device (the device speed) can be handled, and thinned-conveying (skip-conveying) can be carried out efficiently.

In an image forming device of a third aspect of the present invention, in the image forming device of the first aspect, the conveying body holds and conveys two recording media on a first surface (surface A) and a second surface (surface B) that serve as the holding regions, and the plural conveying modes include: a first conveying mode in which a pattern of skipping one recording medium that supplies the recording media in continuation to the first surface (surface A) is executed, and thereafter, a surface on which the recording media are conveyed is switched to the second surface (surface B), and a pattern of skipping one recording medium that supplies the recording media in continuation is executed, and a second conveying mode in which only a pattern of skipping one recording medium, that supplies the recording media in continuation to a same one surface among the first surface (surface A) and the second surface (surface B), is executed.

In accordance with the above-described aspect, the plural conveying modes include a first conveying mode in which a pattern of skipping one recording medium that supplies the recording media in continuation to the first surface (surface A) of the conveying body is executed, and thereafter, the surface of the conveying body on which the recording media are conveyed is switched to the second surface (surface B), and a pattern of skipping one recording medium that supplies the recording media in continuation is executed, and a second conveying mode in which only a pattern of skipping one recording medium, that supplies the recording media in continuation to the same one surface among the first surface (surface A) and the second surface (surface B) of the conveying body, is executed. Due thereto, due to the first conveying mode or the second conveying mode being selected, a case in which the image processing speed does not keep up with the processing speed of the device (the device speed) can be handled, and thinned-conveying (skip-conveying) can be carried out efficiently.

In an image forming device of a fourth aspect of the present invention, in the image forming device of the third aspect, for the first conveying mode, the control device computes time T1 that is a sum total of time A1 that is the product of the number of recording media to be printed of the job to be executed and the unit printing time, and time B that is needed when switching the holding region on which the recording media are conveyed of the peripheral surface of the conveying body during the job, and time C1 over which the conveying body, whose temperature has risen, is cooled after completion of the job, and for the second conveying mode, the control device computes time T2 that is a sum total of time A2 that is the product of the number of recording media to be printed of the job to be executed and the unit printing time, and time C2 over which the conveying body, whose temperature has risen, is cooled after completion of the job, and when T1>T2, the control device executes the second conveying mode.

In accordance with the above-described aspect, time T1 that is a sum total of time A1 that is the product of the number of recording media to be printed of the job to be executed and the unit printing time, and time B that is needed when switching the holding region on which the recording media are conveyed of the peripheral surface of the conveying body during the job, and time C1 over which the conveying body, whose temperature has risen, is cooled after completion of the job, is computed for the first conveying mode. Further, time T2 that is a sum total of time A2 that is the product of the number of recording media to be printed of the job to be executed and the unit printing time, and time C2 over which the conveying body, whose temperature has risen, is cooled after completion of the job, is computed for the second conveying mode. Then, when T1>T2, the second conveying mode is executed. Therefore, the appropriate conveying mode is selected, and thinned-conveying (skip-conveying) can be carried out efficiently.

In an image forming device of a fifth aspect of the present invention, in the image forming device of the first aspect, the image forming section is a droplet ejecting device that ejects droplets onto a surface of a recording medium.

In accordance with the above-described aspect, droplets are ejected by the droplet ejecting device onto the surface of the recording medium that is held at the predetermined holding region of the peripheral surface of the conveying body, and an image can be formed.

In an image forming device of a sixth aspect of the present invention, the image forming device of any one of the first through fifth aspects further has a feed-out device that feeds out a recording medium from a stacking section in which the plural recording media are stacked, wherein the control device executes the plural conveying modes by controlling a feed-out timing of the recording medium that is fed-out from the feed-out device.

In accordance with the above-described aspect, recording media are fed-out successively by the feed-out device from the stacking section in which plural recording media are stacked. The control device executes the plural conveying modes by controlling the feed-out timing of the recording media that are fed-out from the feed-out device. Therefore, the recording media can be held at the appropriate holding region of the conveying body.

An image forming method of a seventh aspect of the present invention includes: providing plural conveying modes that are set such that recording media are thinned-conveyed to a predetermined holding region without using all holding regions of a peripheral surface of a conveying body that holds and conveys the plural recording media at different holding regions of the peripheral surface of the conveying body respectively, and selecting any one of the plural conveying modes on the basis of a number of recording media processed per unit time; and, on the basis of the selected conveying mode, conveying the recording media to a predetermined holding region of the peripheral surface of the conveying body at a predetermined timing, and forming images on surfaces of the recording media.

In accordance with the above-described aspect, there are provided plural conveying modes that are set such that recording media are thinned-conveyed to a predetermined holding region without using all of the holding regions of the peripheral surface of the conveying body. Any one of the plural conveying modes is selected on the basis of the number of recording media processed per unit time. Further, on the basis of the selected conveying mode, the recording media are conveyed to a predetermined holding region of the peripheral surface of the conveying body at a predetermined timing, and images are formed on the surfaces of the recording media. Due thereto, a case in which the image processing speed does not keep up with the processing speed of the device (the device speed) can be handled.

In an image forming method of an eighth aspect of the present invention, in the image forming method of the seventh aspect, any one of the plural conveying modes is selected by using, as a reference, the number of recording media processed per unit time that is computed from a product of a number of recording media to be printed of a job to be executed and a unit printing time, and a time required when switching the holding region on which the recording media are conveyed of the peripheral surface of the conveying body during the job, and a time over which the conveying body, whose temperature has risen, is cooled after completion of the job.

In accordance with the above-described aspect, any one of the plural conveying modes is selected by using, as a reference, the number of recording media processed per unit time that is computed from the product of the number of recording media to be printed of the job to be executed and the unit printing time, and the time required when switching the holding region on which the recording media are conveyed of the peripheral surface of the conveying body during the job, and the time over which the conveying body, whose temperature has risen, is cooled after completion of the job. Due thereto, a case in which the image processing speed does not keep up with the processing speed of the device (the device speed) can be handled, and thinned-conveying (skip-conveying) can be carried out efficiently.

In an image forming method of a ninth aspect of the present invention, in the image forming method of the seventh or eighth aspect, the conveying body holds and conveys two recording media on a first surface (surface A) and a second surface (surface B) that serve as the holding regions, and the plural conveying modes include: a first conveying mode in which a pattern of skipping one recording medium that supplies the recording media in continuation to the first surface (surface A) and forms images on the recording media, is executed, and thereafter, a surface on which the recording media are conveyed is switched to the second surface (surface B), and a pattern of skipping one recording medium that supplies the recording media in continuation and forms images on the recording media is executed, and a second conveying mode in which only a pattern of skipping one recording medium, that supplies the recording media in continuation to a same one surface among the first surface (surface A) and the second surface (surface B) and forms images on the recording media, is executed.

In accordance with the above-described invention, the plural conveying modes include a first conveying mode in which a pattern of skipping one recording medium that supplies the recording media in continuation to the first surface (surface A) of the conveying body and forms images on the recording media is executed, and thereafter, the surface of the conveying body on which the recording media are conveyed is switched to the second surface (surface B), and a pattern of skipping one recording medium that supplies the recording media in continuation and forms images on the recording media is executed, and a second conveying mode in which only a pattern of skipping one recording medium, that supplies the recording media in continuation to a same one surface among the first surface (surface A) and the second surface (surface B) of the conveying body and forms images on the recording media, is executed. The first conveying mode or the second conveying mode is selected on the basis of the number of recording media that are processed per unit time. Due thereto, a case in which the image processing speed does not keep up with the processing speed of the device (the device speed) can be handled, and thinned-conveying (skip-conveying) can be carried out efficiently.

In an image forming method of a tenth aspect of the present invention, in the image forming method of the ninth aspect, for the first conveying mode, time T1 is computed that is a sum total of time Al that is the product of the number of recording media to be printed of the job to be executed and the unit printing time, and time B that is needed when switching the holding region on which the recording media are conveyed of the peripheral surface of the conveying body during the job, and time C1 over which the conveying body, whose temperature has risen, is cooled after completion of the job, and for the second conveying mode, time T2 is computed that is a sum total of time A2 that is the product of the number of recording media to be printed of the job to be executed and the unit printing time, and time C2 over which the conveying body, whose temperature has risen, is cooled after completion of the job, and when T1>T2, the second conveying mode is executed, and at other times, the first conveying mode is executed.

In accordance with the above-described aspect, for the first conveying mode, time T1 is computed that is the sum total of time Al that is the product of the number of recording media to be printed of the job to be executed and the unit printing time, and time B that is needed when switching the holding region on which the recording media are conveyed of the peripheral surface of the conveying body during the job, and time C1 over which the conveying body, whose temperature has risen, is cooled after completion of the job. Further, for the second conveying mode, time T2 is computed that is the sum total of time A2 that is the product of the number of recording media to be printed of the job to be executed and the unit printing time, and time C2 over which the conveying body, whose temperature has risen, is cooled after completion of the job. Then, when T1>T2, the second conveying mode is executed, and, at other times, the first conveying mode is executed. Therefore, the appropriate conveying mode is selected, and thinned-conveying (skip-conveying) can be carried out efficiently.

Because the present invention is structured as described above, cases in which the image processing speed does not keep up with the processing speed of the device (device speed) can be handled, even when cut sheets are used.

BRIEF DESCRIPTION OF THE DRAWINGS

FIG. 4 is a figure that compares produceability in plural conveying patterns when a job is long;

FIG. 5 is a figure that compares produceability in plural conveying patterns when a job is short;

DETAILED DESCRIPTION OF THE INVENTION

Exemplary embodiments of an image forming device relating to the present invention are described hereinafter with reference to the drawings.

<Overall Structure of Image Forming Device of First Exemplary Embodiment>

Figure 1:
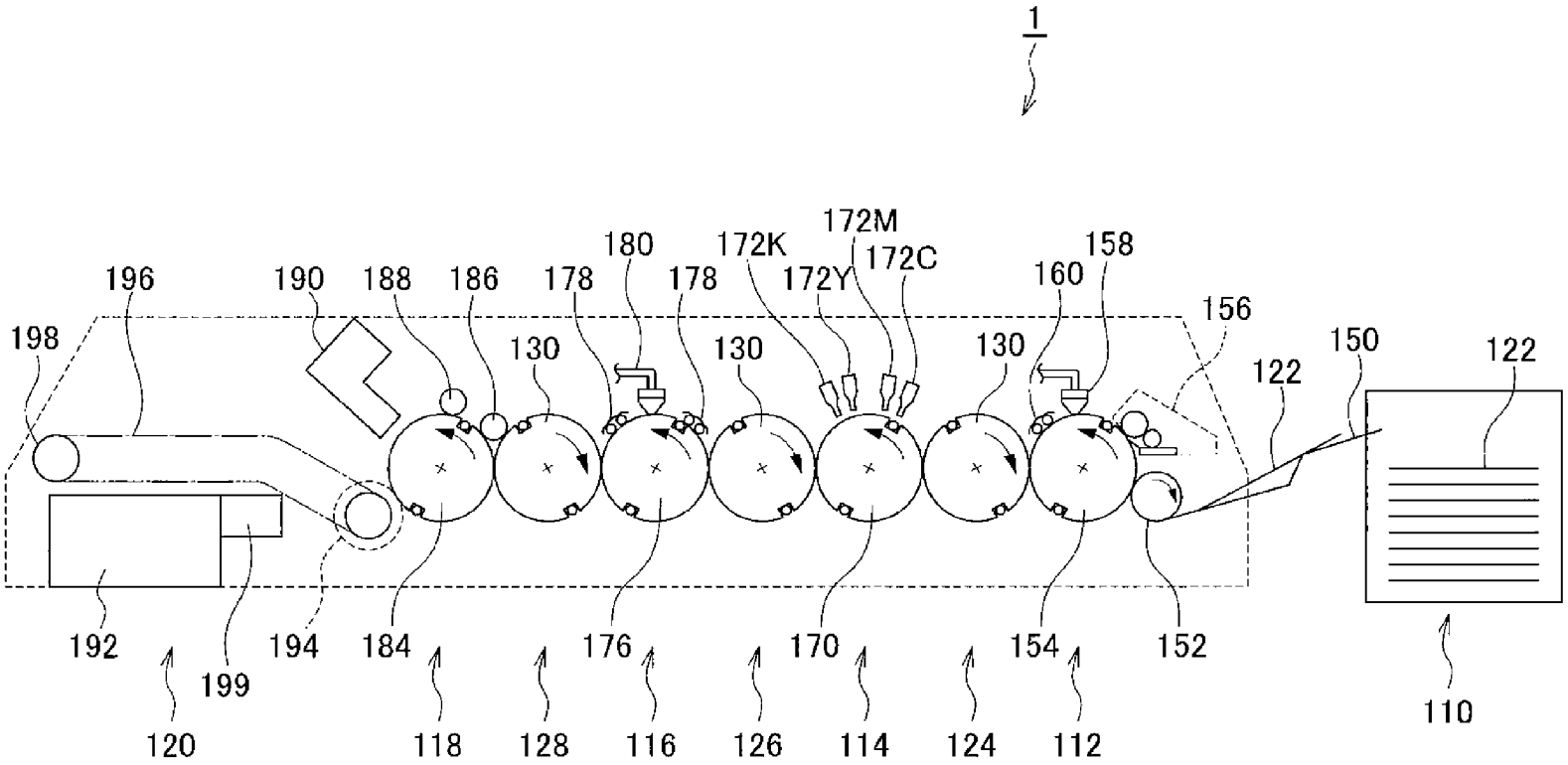
FIG. 1 is a schematic drawing showing the overall structure of an image forming device relating to a first exemplary embodiment of the present invention.
Figure 2:
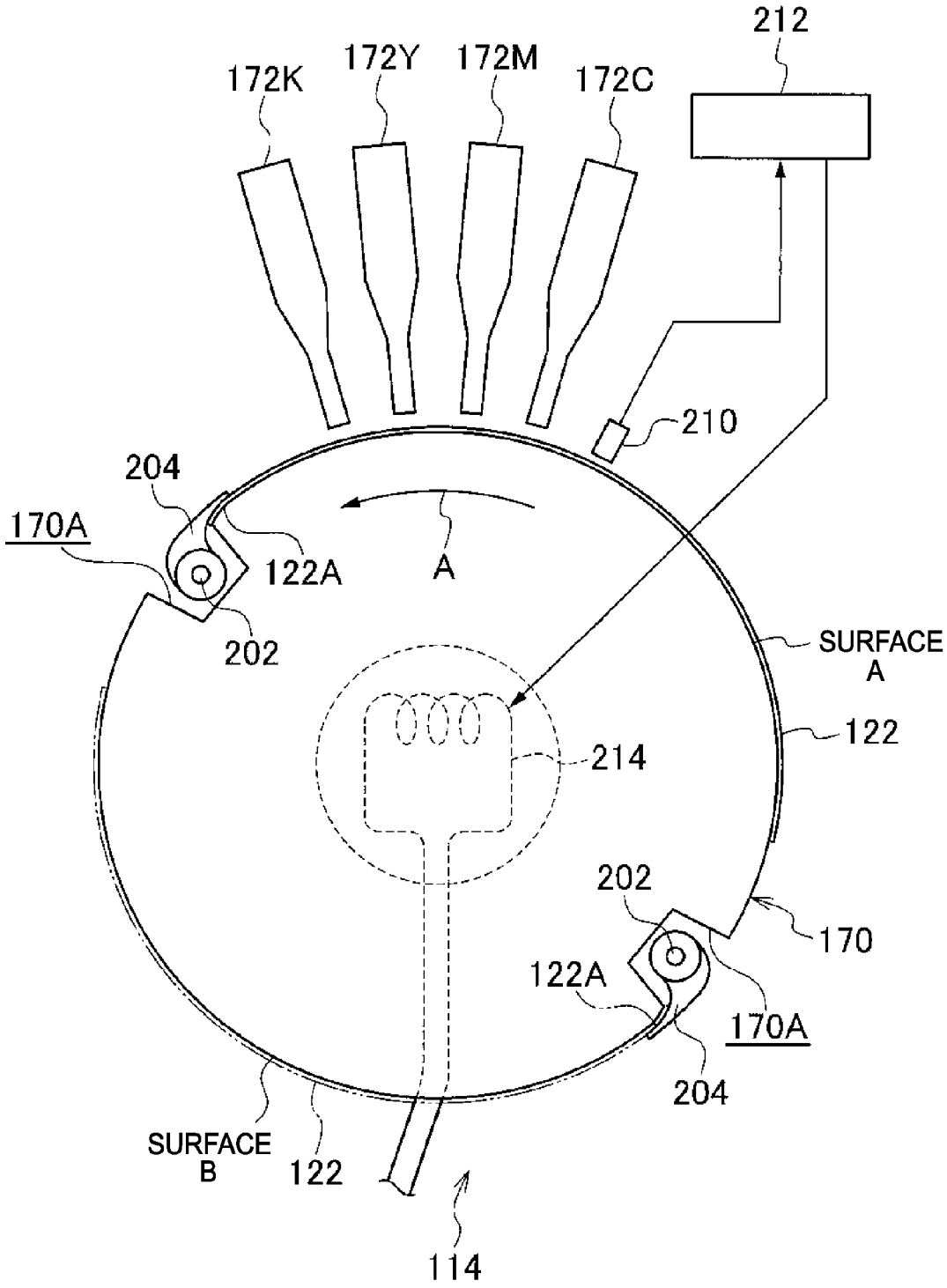
FIG. 2 is a structural drawing showing an image drawing drum and inkjet heads that are used in the image forming device relating to the first exemplary embodiment of the present invention.

A structural example of an inkjet-type image forming device for implementing a conveying device and an image forming device of the present invention, is described hereinafter with reference to FIG. 1 and FIG. 2. FIG. 1 is a schematic drawing (from the side) showing the entire image forming device of a first exemplary embodiment of the present invention, and FIG. 2 is a structural drawing that concentrates on the vicinity of an image drawing drum that is applied to the image forming device of the first exemplary embodiment of the present invention.

An inkjet recording device 1 is an impression-cylinder direct-drawing inkjet recording device that forms a desired color image by ejecting inks (droplets) of plural colors from inkjet heads 172M, 172K, 172C, 172Y that serve as examples of droplet ejecting devices, onto a sheet 122 that is held at an impression cylinder (image drawing drum 170) of an image drawing section 114. The inkjet recording device 1 is an on-demand type image forming device to which is applied a two-liquid reaction (agglomeration) method that carries out image formation on the sheet 122 by applying a processing liquid (ink agglomerating processing liquid) onto the sheet 122 that serves as a recording medium before ejecting inks, and causing the processing liquid and the inks to react.

The inkjet recording device 1 is mainly structured by a sheet feeding section 110, a processing liquid applying section 112, the image drawing section 114, a drying section 116, a fixing section 118, and a sheet discharging section 120.

The sheet feeding section 110 is a mechanism that feeds the sheets 122 to the processing liquid applying section 112. The sheets 112, that are cut paper, are stacked in the sheet feeding section 110. A sheet feed tray 150 is provided at the sheet feeding section 110, and the sheets 122 are fed one-by-one from the sheet feed tray 150 to the processing liquid applying section 112. In the inkjet recording device 1, plural types of the sheets 122 that are different paper types or sizes (media sizes) can be used as the sheets 122. Note that the present exemplary embodiment describes a case in which cut paper is used as the sheets 122.

The processing liquid applying section 112 is a mechanism that applies processing liquid to the recording surface of the sheet 122. The processing liquid contains a component that agglomerates or thickens the color material (pigment or dye) in the ink that is applied at the image drawing section 114. Separation of the ink into the color material and the solvent is promoted by this processing liquid and the ink contacting one another.

Concrete examples of processing liquids that agglomerate or thicken the color material include processing liquids that react with the ink and precipitate or insolubilize the color material within the ink, processing liquid that generate a semi-solid substance (gel) that contains the color material within the ink, and the like. Further, examples of the method of bringing about the reaction between the ink and the processing liquid include: a method of causing a cationic compound within the processing liquid to react with an anionic color material within the ink; a method of, by mixing together an ink and a processing liquid that have different pHs, changing the pH of the ink, and causing dispersion destruction of the pigment within the ink, and agglomerating the pigment; a method of causing dispersion destruction of the pigment within the ink by a reaction with a polyvalent metal salt within the processing liquid, and agglomerating the pigment; and the like.

Methods of applying the processing liquid include ejecting of droplets by an inkjet head, application by a roller, uniform application by spraying, and the like.

As shown in FIG. 1, the processing liquid applying section 112 has a supply cylinder 152, a processing liquid drum 154, and a processing liquid coating device 156. The processing liquid drum 154 is a drum that holds the sheet 122 and rotates and conveys the sheet 122. Grippers, that are claw-shaped and serve as holding means (a holding mechanism), are provided at the outer peripheral surface of the processing liquid drum 154, and the leading end of the sheet 122 can be held by the sheet 122 being nipped-in between the claws of the holding means and the peripheral surface of the processing liquid drum 154.

Suction holes may be provided in the outer peripheral surface of the processing liquid drum 154, and a suction means for carrying out suction from the suction holes may be connected thereto. Due thereto, the sheet 122 can be held tightly to the peripheral surface of the processing liquid drum 154.

The processing liquid coating device 156 is provided at the outer side of the processing liquid drum 154 so as to face the peripheral surface thereof. The processing liquid coating device 156 is structured by a processing liquid container in which processing liquid is stored, an anilox roller of which a portion is immersed in the processing liquid in the processing liquid container, and a rubber roller that is pressed to contact the anilox roller and the sheet 122 that is on the processing liquid drum 154 and transfers the processing liquid, after measurement thereof, onto the sheet 122. In accordance with this processing liquid coating device 156, the processing liquid can be coated onto the sheet 122 while being measured. A warm air heater 158 and an IR heater 160, that dry the processing liquid coated on the sheet 122, are provided at the downstream side, in the conveying direction of the sheet 122, of the processing liquid coating device 156.

In order to prevent floating of the color material (the phenomenon of the ink droplets floating on the processing liquid and dots not being formed at the desired positions), drying of the solvent component within the processing liquid is carried out by the warm air heater 158 and the IR heater 160 after ejection of the processing liquid.

The sheet 122, to which the processing liquid has been applied at the processing liquid applying section 112, is transferred from the processing liquid drum 154 via an intermediate conveying section 124 (a transfer cylinder 130) to the image drawing drum 170 of the image drawing section 114. The image drawing section 114 has the image drawing drum 170 that serves as an example of a conveying body that conveys the sheet 122, and the inkjet heads 172M, 172K, 172C, 172Y that serve as an example of a liquid droplet ejecting device (an image forming section) and are disposed so as to face the peripheral surface of the image drawing drum 170. In the same way as the processing liquid drum 154, the image drawing drum 170 has grippers 204, that are claw-shaped and serve as holding means (a holding mechanism), at the outer peripheral surface thereof (see FIG. 2). The sheet 122 that held at the image drawing drum 170 is conveyed with the recording surface thereof facing outward, and inks are applied to the recording surface of the sheet 122 from the inkjet heads 172M, 172K, 172C, 172Y.

Each of the inkjet heads 172M, 172K, 172C, 172Y is a full-line-type inkjet recording head (inkjet head) having a length that corresponds to the maximum width of the image formation region at the sheet 122. Nozzle rows, at which plural nozzles (ejection openings) for ejecting ink are arrayed, are formed at the ink ejecting surface of each of the inkjet heads 172M, 172K, 172C, 172Y, over the entire width of the image formation region. Each of the inkjet heads 172M, 172K, 172C, 172Y is set so as to extend in a direction orthogonal to the conveying direction of the sheet 122 (the rotating direction of the image drawing drum 170).

Although not illustrated, suction holes are provided in the outer peripheral surface of the image drawing drum 170, and a suction device for carrying out suction of the sheet 122 from the suction holes is connected thereto. Due thereto, the sheet 122 is sucked to the peripheral surface of the image drawing drum 170, and can be held tightly to the peripheral surface of the image drawing drum 170.

Droplets of inks of corresponding colors are ejected from the respective inkjet heads 172M, 172K, 172C, 172Y toward the recording surface of the sheet 122 that is held tightly on the image drawing drum 170. Due thereto, the inks contact the processing liquid, that was applied in advance to the recording surface at the processing liquid applying section 112, and the pigment and resin particles that are dispersed within the inks agglomerate, and agglomerates are formed. Flowing of pigment on the sheet 122, and the like, are thereby prevented, and an image is formed on the recording surface of the sheet 122.

The sheet 122, on which an image has been formed at the image drawing section 114, is transferred from the image drawing drum 170 via an intermediate conveying section 126 to a drying drum 176 of the drying section 116. The drying section 116 is a mechanism that dries the moisture contained in the solvent within the ink, i.e., the solvent that separated due to the agglomerating action. The drying mechanism is structured from two drying means that are (a) drying means for the side of the sheet 122 opposite the recording surface, and (b) drying means for the recording surface side. A structure in which a heating member is pushed against the sheet 122 from the side of the sheet 122 opposite the recording surface, and heat is supplied by contact heat transfer, or the like, is used as drying means (a). A structure in which warm air is blown-out from the recording surface side of the sheet 122, or the like, is used as drying means (b). In addition to these, there are also structures that supply heat by radiation by carbon heaters, halogen heaters, or the like.

It is preferable that the remaining amount of moisture of the ink moisture after drying is greater than or equal to 1 $g/m^2$ and less than 3.5 $g/m^2$. This is because, if moisture in an amount of greater than or equal to 3.5 $g/m^2$ remains, offset toward fixing rollers 186, 188 that are described later arises, and further, if less than 1 $g/m^2$ of moisture remains, the moisture that has seeped into the sheet 122 also is evaporated, and therefore, a large amount of energy is needed.

As shown in FIG. 1, the drying section 116 has the drying drum 176, and plural IR (infrared) heaters 178, and a warm air heater 180 that is disposed between the respective IR heaters 178.

In the same way as the processing liquid drum 154, the drying drum 176 has claw-shaped holding means (grippers) at the outer peripheral surface thereof, and can hold the leading end of the sheet 122 by the holding means. The temperature and the air volume of the warm air that is blown-out from the warm air heater 180 toward the sheet 122, and the temperatures of the respective IR heaters, are sensed by temperature sensors, and are sent as temperature information to an unillustrated control section. Various drying conditions are realized due to the control section appropriately adjusting the temperature and the air volume of the warm air and the temperatures of the respective IR heaters on the basis of this temperature information.

Further, it is preferable that the surface temperature of the drying drum 176 be set to, for example, greater than or equal to 50° C. by internal heating members (heaters and the like). By carrying out heating from the reverse surface of the sheet 122, drying is accelerated and image destruction at the time of fixing can be prevented. Note that the upper limit of the surface temperature of the drying drum 176 is not particularly limited, but is preferably set to less than or equal to 75° C. (and more preferably less than or equal to 60° C.) from the standpoint of safety (prevention of burns due to high temperatures) in maintenance work such as cleaning ink that has adhered to the surface of the drying drum 176 and the like.

Further, as mentioned above, it is known that there is less expansion and contraction of the sheet 122 at higher drying cylinder temperatures (surface temperatures of the drying drum 176). Therefore, to the extent that the aforementioned safety is not adversely affected, higher surface temperatures of the drying drum 176 can suppress the effects of cockling.

Due to drying being carried out while the sheet 122 is rotated and conveyed while being held at the outer peripheral surface of the drying drum 176 with the recording surface of the sheet 122 facing outward (i.e., in a state in which the recording surface of the sheet 122 is curved so as to become the convex side), the occurrence of wrinkles and floating-up of the sheet 122 can be prevented, and uneven drying due thereto can be prevented.

The sheet 122, on which drying processing has been carried out at the drying section 116, is transferred from the drying drum 176 via an intermediate conveying section 128 to a fixing drum 184 of the fixing section 118. The fixing section 118 is structured by the fixing drum 184, a first fixing roller 186, a second fixing roller 188, and an in-line sensor 190.

In the same way as the processing liquid drum 154, the fixing drum 184 has claw-shaped holding means (grippers) at the outer peripheral surface thereof, and can hold the leading end of the sheet 122 by the holding means. Due the rotation of the fixing drum 184, the sheet 122 is conveyed with the recording surface thereof facing outward, and fixing processing by the first fixing roller 186 and the second fixing roller 188, and inspection by the in-line sensor 190, are carried out on this recording surface.

The first fixing roller 186 and the second fixing roller 188 are roller members for welding the resin particles (in particular, self-dispersing polymer particles) within the inks and making the inks into a coating film by heating and pressurizing the inks, and are structured so as to heat and apply pressure to the sheet 122.

Concretely, the first fixing roller 186 and the second fixing roller 188 are disposed so as to press-contact the fixing drum 184, and structure nip rollers together with the fixing drum 184. Due thereto, the sheet 122 is nipped between, on the one hand, the first fixing roller 186 and the second fixing roller 188, and, on the other hand, the fixing drum 184, and is nipped at a predetermined nip pressure (e.g., 0.3 MPa), and fixing processing is carried out.

Further, the first fixing roller 186 and the second fixing roller 188 are structured by heating rollers in which a halogen lamp is assembled within a pipe made of a metal having good thermoconductivity such as aluminum or the like, and are controlled to a predetermined temperature (e.g., 60 to 80° C.).

Due to the sheet 122 being heated by these heating rollers, thermal energy of greater than or equal to the Tg (glass transition temperature) of the resin particles (latex) contained in the ink is applied, and the resin particles are fused. Due thereto, push-in fixing into the recesses and protrusions of the sheet 122 is carried out, and the unevenness of the surface of the image is leveled, and gloss is obtained.

The in-line sensor 190 is a measuring means for measuring a check pattern and the moisture content, surface temperature, degree of gloss, and the like of the image fixed on the sheet 122, and a CCD line sensor or the like is used therefor.

Because the resin particles within the image layer, that is a thin layer formed at the drying section 116, are heated and pressurized and fused by the fixing rollers 186, 188, the resin particles can be fixed to the sheet 122 by the fixing section 118. Further, due to the surface temperature of the fixing drum 184 being set to greater than or equal to 50° C. and the sheet 122, that is held at the outer peripheral surface of the fixing drum 184, being heated from the reverse surface, drying is accelerated, image destruction at the time of fixing can be prevented, and the image strength can be increased by the effect of raising the image temperature.

The sheet discharging section 120 is provided at the recording medium conveying direction downstream side of the fixing section 118. The sheet discharging section 120 has a discharge tray 192. A transfer cylinder 194, a conveying belt 196, and a tension roller 198 are provided between the discharge tray 192 and the fixing drum 184 of the fixing section 118, so as to face both. The sheet 122 is sent to the conveying belt 196 by the transfer cylinder 194, and is discharged out to the discharge tray 192.

A cool air jetting nozzle 199 is provided so as to be annexed to the discharge tray 192, so that cooling of the sheet 122 can be carried out by cool air being blown from the cool air jetting nozzle 199.

Further, although not shown in FIG. 1, the inkjet recording device 1 has, in addition to the above-described structures, ink storage tanks that supply inks to the respective inkjet heads 172M, 172K, 172C, 172Y, and means for supplying the processing liquid to the processing liquid applying section 112. The inkjet recording device 1 also has head maintenance sections that carry out cleaning (wiping of the nozzle surfaces, purging, suctioning of nozzles, and the like) of the respective inkjet heads 172M, 172K, 172C, 172Y, position detecting sensors that detect the position of the sheet 122 on the medium conveying path, temperature sensors that detect the temperatures of the respective sections of the device, and the like.

The inkjet recording device 1 shown in FIG. 1 may be structured to have plural seasoning devices that are used at the discharge tray 192, and the respective seasoning devices can move between the sheet discharging section 120 and the sheet feeding section 110.

<Details of Image Drawing Section>

As shown in FIG. 2, the image drawing section 114 has the image drawing drum 170 that conveys the sheet 122, and the inkjet heads 172M, 172K, 172C, 172Y that are disposed along the peripheral surface of the image drawing drum 170 so as to face the image drawing drum 170. Further, a temperature sensor 210, that detects the temperature of the peripheral surface of the image drawing drum 170, is provided at the upstream side, in the sheet conveying direction of the image drawing drum 170 (arrow A direction), of the inkjet heads 172M, 172K, 172C, 172Y. The signal outputted from the temperature sensor 210 is inputted to a control device (control means) 212.

Two recesses 170A are provided in the peripheral surface of the image drawing drum 170 at positions that oppose one another with the central portion therebetween. The recesses 170A are formed along the transverse direction of the image drawing drum 170. A shaft portion 202 is disposed in the recess 170A along the transverse direction of the image drawing drum 170. The grippers (holding means) 204, that are claw-shaped and grasp a leading end 122A (the conveying direction front end portion) of the sheet 122, are provided at the shaft portion 202. The plural grippers 204 are provided at predetermined intervals at the shaft portion 202. Due to the grippers 204 grasping the leading end 122A of the sheet 122 due to the rotation of the shaft portion 202, the sheet 122 is held at the peripheral surface of the image drawing drum 170 and conveyed in the arrow A direction.

In the present exemplary embodiment, due to two of the grippers 204 being provided at the peripheral surface of the image drawing drum 170, the sheets 122 are held at two holding regions of the peripheral surface of the image drawing drum 170, i.e., surface A and surface B, respectively. Due thereto, two of the sheets 122 can be held and conveyed by the image drawing drum 170 that rotates one time.

Further, a heater 214 is fixed and supported at the interior of the image drawing drum 170. The rotating body, that structures the image drawing drum 170 that is provided at the periphery of the heater 214, rotates. The peripheral surface of the image drawing drum 170 is raised to a predetermined temperature by the heater 214. The temperature of the peripheral surface of the image drawing drum 170 is detected by the temperature sensor 210, and the on/off state of the heater 214 is controlled by the control device (control means) 212. Due thereto, the peripheral surface of the image drawing drum 170 is controlled to a predetermined temperature, and, immediately after the inks are ejected from the inkjet heads 172M, 172K, 172C, 172Y onto the surface of the sheet 122 held at the peripheral surface of the image drawing drum 170, the inks can be dried.

At the time of forming image on the sheets 122, it is preferable that the processing speed of the device (the device speed) is suited to the image processing speed. This is because, if the image processing is slow, the produceability of the printed matter (the image formation product) deteriorates on the whole even if the processing speed of the device is fast. For example, it is also possible to make the processing speed of the device suit the image processing speed, but it is often the case that the processing speed of the device is determined by constraints such as the frequency that is favorable for ink ejection from the inkjet heads 172M, 172K, 172C, 172Y, and the need for measures such as avoiding the natural frequency, or the like, in order to suppress device vibrations.

Therefore, in order to absorb the difference in the both speeds, when the image processing speed does not keep up with the processing speed of the device, a measure such as thinning the sheets 122 that are conveyed to the image drawing drum 170, or the like, is taken. Skip-conveying (thinned-conveying), in which, for example, the sheet 122 is conveyed to surface A of the image drawing drum 170 and the sheet 122 is not conveyed to surface B of the image drawing drum, is carried out. Images are formed only on the sheets 122 that are held on surface A of the image drawing drum 170.

For example, when color images differ sheet-by-sheet such as in a magazine or the like, it is often the case that the image processing speed becomes unable to keep up with the processing speed of the device. In the present exemplary embodiment, when printing color images that differ per sheet, control is carried out such that skip-conveying (thinned-conveying) is carried out.

<Details of Sheet Feeding Section 110>

Figure 3:
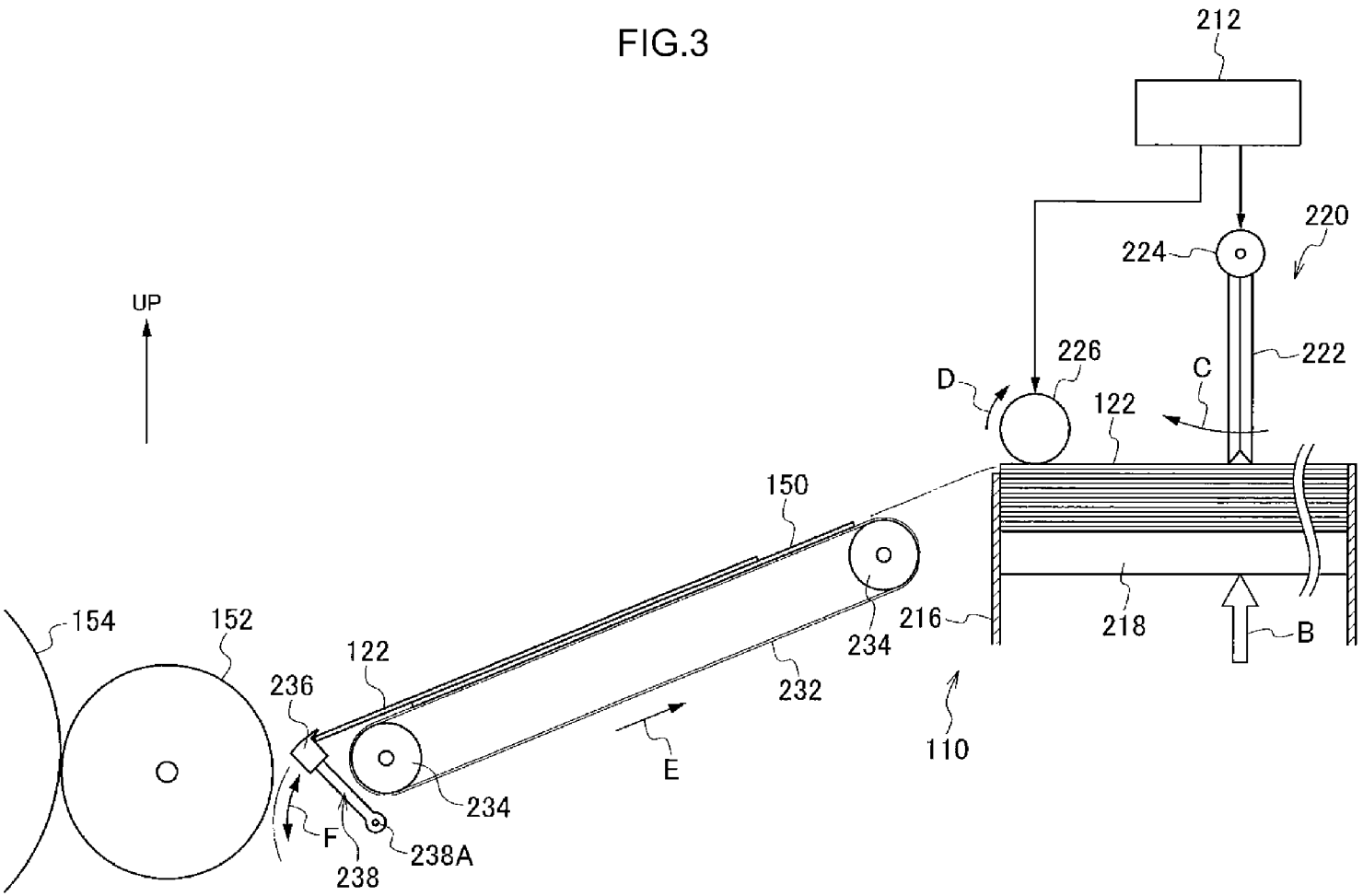
FIG. 3 is a structural drawing showing a sheet feeding device that is provided at a sheet feeding section that supplies sheets.

The aforementioned skip-conveying is carried out by controlling the timing at which the sheets 122 are fed at the sheet feeding section 110. As shown in FIG. 3, a sheet feeding stand 218, on which the sheets 122 are stacked within a box 216, is provided at the sheet feeding section 110 that serves as an example of a stacking section. A sheet feeding device 220, that serves as an example of a feed-out device that successively supplies the sheets 122 that are stacked on the sheet feeding stand 218, is provided above the sheet feeding stand 218.

The sheet feeding device 220 has suckers 222 that suck the sheet 122, and a roller 226 that feeds the sheet 122 out. The sheet feeding stand 218 pushes the sheets 122 upward toward the side of the roller 226 (in an arrow B direction) by an unillustrated urging means. Shaft portions 224 that rotate the suckers 222 are provided at the top portions of the suckers 222. Due to the sheet 122 being sucked by the suckers 222 and the suckers 222 being rotated in an arrow C direction around the shaft portions 224, the sheet 122 is transferred to the roller 226. The rotating operation of the suckers 222 and the rotation of the roller 226 are synchronous. Namely, the suction by the suckers 222 is stopped (set in an off state) at the time of transferring the sheet 122. The roller 226 rotates in an arrow D direction at the time when the sheet 122 is transferred from the suckers 222, and feeds the sheet 122.

The sheet feed tray 150 that is disposed such that the conveying direction downstream side end portion thereof slopes downward, a conveying belt 232 that conveys the sheet 122 supplied onto the sheet feed tray 150, and front abutment portions 236 that are disposed at the conveying direction downstream side of the conveying belt 232 so as to be abutted by the leading end of the sheet 122, are provided at the conveying direction downstream side of the roller 226. The conveying belt 232 is an endless belt, and circulates in an arrow E direction in a state of being trained around two supporting rollers 234. The sheet 122 that is supplied onto the sheet feed tray 150 is conveyed by the conveying belt 232 until the leading end of the sheet 122 hits the front abutment portions 236. The front abutment portions 236 are supported so as to be able to rotate in arrow F directions around shaft portions 238A of arms 238. Due to the front abutment portions 236 rotating around the shaft portions 238A in a state in which the leading end of the sheet 122 abuts the front abutment portions 236, the sheet 122 is supplied to the supply cylinder 152. The sheet 122 that is supplied to the supply cylinder 152 is conveyed to the processing liquid drum 154.

In the present exemplary embodiment, skip-conveying (thinned-conveying) is carried out by the control device 212 controlling the timing of the suctioning and rotating of the suckers 222 and the sheet feeding timing of the roller 226. For example, control is carried out such that the sheet 122 is conveyed to surface A of the image drawing drum 170, and the sheet 122 is not conveyed to surface B of the image drawing drum 170 as shown in FIG. 2.

<Details of Skip-Conveying>

The inkjet recording device 1 is provided with plural conveying modes that are set such that the sheets 122 can be thinned-conveyed (skip-conveyed) to surface A or surface B of the image drawing drum 170, without using both surface A and surface B. When the image processing speed does not keep up with the processing speed of the inkjet recording device 1 (the device speed) (e.g., when printing color images that differ sheet-by-sheet), the control device 212 carries out control such that any one of plural conveying modes is selected on the basis of a number of sheets processed per unit time of the inkjet recording device 1 (the produceability of the printed matter), and the sheets 122 are conveyed to a predetermined surface (surface A or surface B) of the image drawing drum 170 at a predetermined timing.

For example, the control device 212 selects any one of plural conveying modes by using, as a reference, a number of sheets processed per unit time (the produceability of the printed matter) that is computed from the product of the unit printing time and the number of sheets to be printed of the job to be executed, and the time that is required when switching the surface, on which the recording medium is conveyed, between surface A and surface B of the image drawing drum 170 during a job, and the time for cooling the image drawing drum 170, whose temperature has risen, after completion of the job. Here, a job means the processing of printing, in continuation, sheets that are grouped together arbitrarily. The operator inputs the number of sheets that are to be printed in a single job (e.g., 200 sheets, 500 sheets, 1000 sheets or the like) from an unillustrated input device that is provided at the inkjet recording device 1.

The relationships between plural conveying patterns and produceability are shown in FIG. 4 and FIG. 5.

As shown in FIG. 4, conveying pattern 1 (No. 1) is a conveying pattern of the sheets 122 in both which surface A and surface B of the image drawing drum 170 are used alternately. Namely, this is a usual conveying pattern (usual mode) in which skip-conveying is not carried out. Further, conveying pattern 2 (No. 2) is a pattern of skip-conveying in which the sheets 122 are conveyed while skipping two sheets and while switching the surface alternately in the order of surface A, surface B, surface A, surface B of the image drawing drum 170. Conveying pattern 3 (No. 3) is a pattern of skip-conveying in which the sheets 122 are conveyed continuously at only surface A of the image drawing drum 170 while skipping one sheet. Conveying pattern 4 (No. 4) is a conveying pattern of skip-conveying in which the sheets 122 are conveyed continuously at only surface A of the image drawing drum 170 while skipping one sheet, and thereafter, the surface on which the sheets 122 are conveyed is switched to surface B, and the sheets 122 are conveyed continuously while skipping one sheet.

In FIG. 4, in conveying pattern 1, when images are formed on 500 of the sheets 122 for 10 minutes, and then images are formed on 500 of the sheets 122 for 10 minutes, the number of sheets of the job is defined as "1". At this time, the time of the job that is executed (the product of the number of printed sheets (1000) and the unit printing time) is 20 minutes. Further, the time over which the image drawing drum 170, whose temperature has risen, is cooled after completion of the job is 20 minutes, and the total processing time is 40 minutes. The produceability of the printed matter (the number of sheets processed per unit time) at this time is 1000 sheets/40 minutes, which is "25".

Conveying pattern 2 is a pattern of skip-conveying by skipping two sheets, and therefore, the number of sheets of the job is "1/3". Further, the time over which the image drawing drum 170, whose temperature has risen, is cooled after completion of the job is 47 minutes, and the total processing time is 67 minutes (20 minutes+47 minutes). The produceability of the printed matter (the number of sheets processed per unit time) at this time is 333 sheets/67 minutes, which is "4.97".

Conveying pattern 3 is a pattern of skip-conveying by skipping one sheet, and therefore, the number of sheets of the job is "1/2". Further, the time over which the image drawing drum 170, whose temperature has risen, is cooled after completion of the job is 60 minutes, and the total processing time is 80 minutes (20 minutes+60 minutes). Namely, because only surface A of the image drawing drum 170 is used in continuation, the cooling time of the image drawing drum 170 is longer than in conveying pattern 2. The produceability of the printed matter (the number of sheets processed per unit time) at this time is 500 sheets/80 minutes, which is "6.25".

Conveying pattern 4 is a pattern of skip-conveying by skipping one sheet, and therefore, the number of sheets of the job is "1/2". Further, the time required when switching between surface A and surface B of the image drawing drum 170 is 5 minutes. The time required when switching between surface A and surface B of the image drawing drum 170 is a value that is particular to the inkjet recording device 1, and a substantially fixed time is needed even if the numbers of sheets that are printed before and after the switching change. For example, in the skip-conveying by skipping one sheet in which the sheets 122 are conveyed continuously only at surface A of the image drawing drum 170, all of the sheets 122 during conveying at the inkjet recording device 1 are discharged once to the discharge tray 192 (see FIG. 1), and thereafter, the skip-conveying by skipping one sheet in which the sheets 122 are conveyed continuously only at surface B of the image drawing drum 170 is newly carried out. Therefore, the aforementioned switching time is needed. Further, the time over which the image drawing drum 170, whose temperature has risen, is cooled after completion of the job is 40 minutes, and the total processing time is 65 minutes (20 minutes+5 minutes+40 minutes). Namely, time is needed to switch between surface A and surface B, but because this switching time is during the job, the cooling time of the image drawing drum 170 is shorter than in conveying pattern 3. The produceability of the printed matter (the number of sheets processed per unit time) at this time is 500 sheets/65 minutes, which is "7.69".

Accordingly, it can be understood that, in the case of a long job having 1000 sheets to be printed, the produceability (number of sheets processed per unit time) is highest with conveying pattern 4.

In FIG. 5, in conveying pattern 1, when images are formed on 100 of the sheets 122 for 2 minutes, and then images are formed on 100 of the sheets 122 for 2 minutes, the number of sheets of the job is defined as "1". Namely, FIG. 5 illustrates the case of a "short job". At this time, the time of the job that is executed (the product of the number of printed sheets (200) and the unit printing time) is 4 minutes. Further, the time over which the image drawing drum 170, whose temperature has risen, is cooled after completion of the job is 4 minutes, and the total processing time is 8 minutes. The produceability of the printed matter (the number of sheets processed per unit time) at this time is 200 sheets/8 minutes, which is "25".

Conveying pattern 2 is a pattern of skip-conveying by skipping two sheets, and therefore, the number of sheets of the job is "1/3". Further, the time over which the image drawing drum 170, whose temperature has risen, is cooled after completion of the job is 9.4 minutes, and the total processing time is 13.4 minutes (4 minutes+9.4 minutes). The produceability of the printed matter (the number of sheets processed per unit time) at this time is 67 sheets/13.4 minutes, which is "5".

Conveying pattern 3 is a pattern of skip-conveying by skipping one sheet, and therefore, the number of sheets of the job is "1/2". Further, the time over which the image drawing drum 170, whose temperature has risen, is cooled after completion of the job is 12 minutes, and the total processing time is 16 minutes (4 minutes+12 minutes). The produceability of the printed matter (the number of sheets processed per unit time) at this time is 100 sheets/16 minutes, which is "6.25".

Conveying pattern 4 is a pattern of skip-conveying by skipping one sheet, and therefore, the number of sheets of the job is "1/2". Further, the time required when switching between surface A and surface B of the image drawing drum 170 is 5 minutes. Moreover, the time over which the image drawing drum 170, whose temperature has risen, is cooled after completion of the job is 8 minutes, and the total processing time is 17 minutes (4 minutes+5 minutes+8 minutes). The produceability of the printed matter (the number of sheets processed per unit time) at this time is 100 sheets/17 minutes, which is "5.88".

Accordingly, it can be understood that, when 200 sheets are printed, the produceability (number of sheets processed per unit time) is highest with conveying pattern 3.

As shown in FIG. 4 and FIG. 5, dividing the skip-conveying in accordance with the length of the job improves the produceability of the printed matter. In the present exemplary embodiment, two conveying modes are set, with conveying pattern 4 being "conveying mode I" and conveying pattern 3 being "conveying mode II". When the time for switching between surface A and surface B of the image drawing drum 170 is long (when the length of the job increases, the switching time also increases), it is effective to divide the skip-conveying into conveying mode I and conveying mode II. Note that three conveying modes may be set with conveying pattern 2 being "conveying mode III".

For example, in the case of a long job, produceability of the printed matter is high with the conveying pattern of "surface AAAAAA . . . (switch) surface BBBBBB . . . " which is conveying mode I. On the other hand, in the case of a short job, produceability of the printed matter is higher with the conveying pattern of "surface A•A•A•A•A•A . . . " which is conveying mode II.

Figure 6:
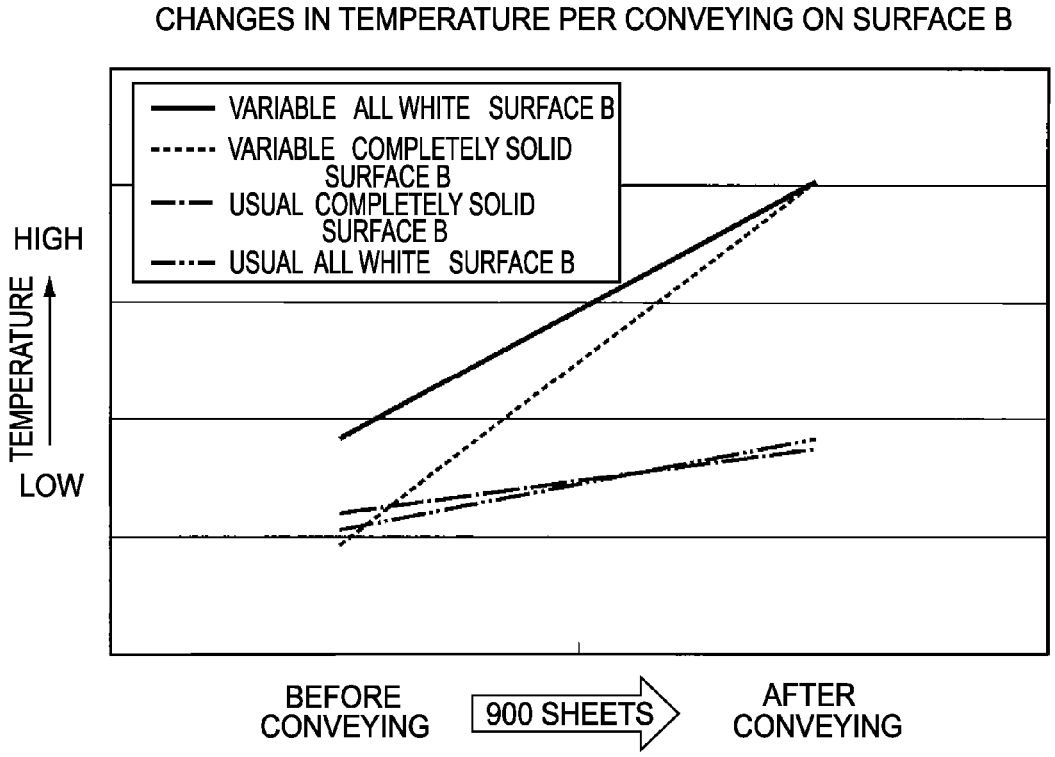
FIG. 6 is a graph that compares relationships between a number of conveyed sheets and temperature per conveying of surface B of the image drawing drum.

Changes in temperature, per conveying, of surface B of the image drawing drum 170 before the conveying of the sheets 122 and after 900 of the sheets 122 have been conveyed, are shown in FIG. 6. In FIG. 6, "variable" shows the change in temperature of surface B in the case of one-surface conveying (skip-conveying) only to surface A of the image drawing drum 170. Further, "usual" shows the change in temperature of surface B when the sheets 122 are conveyed alternately to surface A and surface B of the image drawing drum 170 without skip-conveying. Moreover, all white and completely solid describe the images that are printed on the sheets 122. As shown in FIG. 6, it can be understood that, in the case of one-surface conveying (skip-conveying) only to surface A of the image drawing drum 170, as compared with a case without skip-conveying, the temperature of surface B rises because the sheets 122 are not conveyed to surface B.

Figure 7:
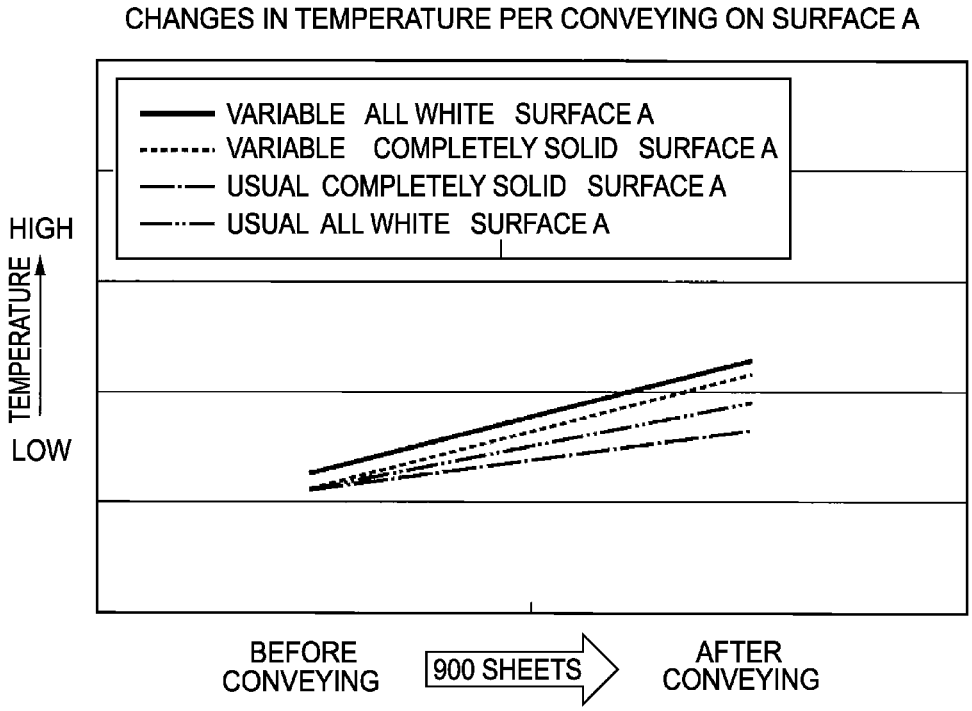
FIG. 7 is a graph that compares relationships between a number of conveyed sheets and a temperature per conveying of surface A of the image drawing drum.

Changes in temperature, per conveying, of surface A of the image drawing drum 170 before the conveying of the sheets 122 and after 900 of the sheets 122 have been conveyed, are shown in FIG. 7. In FIG. 7, "variable" shows the change in temperature of surface A in the case of one-surface conveying (skip-conveying) only to surface A of the image drawing drum 170. Further, "usual" shows the change in temperature of surface A when the sheets 122 are conveyed alternately to surface A and surface B of the image drawing drum 170 without skip-conveying. As shown in FIG. 7, it can be understood that, in the case of one-surface conveying (skip-conveying) only to surface A of the image drawing drum 170, the rise in the temperature of surface A hardly differs at all from that of the usual case (without skip-conveying) because the sheets 122 are conveyed to surface A.

Accordingly, the following are derived as a result of assuming the extent of the rise in temperature of surface A and surface B of the image drawing drum 170 from the way of conveying.

(1) Because the time over which the temperature of the peripheral surface of the image drawing drum 170 is lowered after completion of a job is very much longer than the printing time of the job, not raising the temperature of the peripheral surface of the image drawing drum 170 contributes to making the job efficient.

(2) In order to not raise the temperature of the peripheral surface of the image drawing drum 170, it is effective to switch between surface A and surface B, but a fixed switching time is required therefor. In the case of a short job, because the switching time is long, the effect of making the job efficient is weak, and it is more effective to lower the temperature of the peripheral surface of the image drawing drum 170 after completion of the job. Namely, the optimal conveying pattern is determined in accordance with the job, from the number of sheets processed per unit time that is derived from the above-described printing time, time for switching between surface A and surface B, cooling time, and the like.

On the basis of the above-described results, at the inkjet recording device 1 of the present exemplary embodiment, there are provided: conveying mode I (a first conveying mode) that executes a pattern of skipping one sheet in which the sheets 122 are conveyed (supplied) to surface A of the image drawing drum 170 in continuation, and thereafter, switches the surface on which the sheets 122 are conveyed to surface B, and executes a pattern of skipping one sheet in which the sheets 122 are conveyed (supplied) in continuation; and conveying mode II (a second conveying mode) that executes a pattern of skipping one sheet in which the sheets 122 are conveyed (supplied) only to surface A of the image drawing drum 170 in continuation. At the inkjet recording device 1, when the image processing speed does not keep up with the processing speed of the device (the device speed), the appropriate conveying mode is selected and skip-conveying is carried out by the control device 212.

Figure 8:
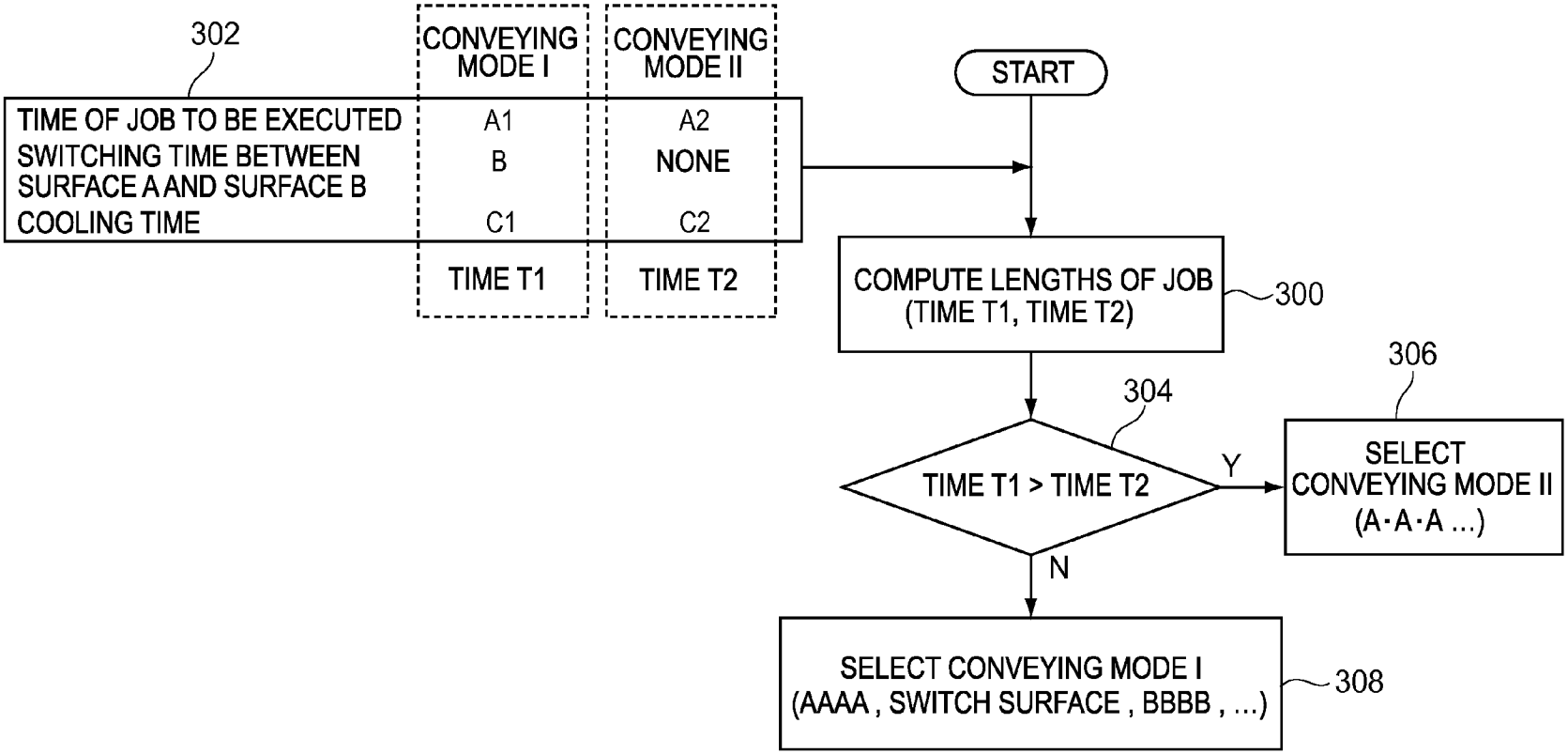
FIG. 8 is a flowchart showing the flow of processings for selecting an appropriate conveying mode from two conveying modes.

The flow of the processings of selecting the appropriate conveying mode from among conveying mode I and conveying mode II is shown in FIG. 8.

As shown in FIG. 8, when the skip-conveying processing starts, the length of the job in each conveying mode is computed in step 300. In step 300, total times (processing times) T1, T2 of the printing process in accordance with conveying mode I and conveying mode II are computed by using table 302. The computing of the times (processing times) T1, T2 is carried out by using, as a reference, the number of sheets to be printed of the job of one time that is inputted from the unillustrated input device. In other words, the total times (processing times) T1, T2 in accordance with conveying mode I and conveying mode II for the same number of sheets to be printed are computed.

Concretely, for conveying mode I (the first conveying mode), the total time T1 is computed which is the sum total of time A1 that is the product of the number of sheets to be printed of the job to be executed and the unit printing time (i.e., the time A1 is the time obtained by dividing the number of sheets to be printed by the produceability per unit time), and time B that is needed when switching surface A, on which the sheets 122 are conveyed, of the image drawing drum 170 to surface B during the job, and time C1 over which the image drawing drum 170, whose temperature has risen, is cooled after completion of the job. Further, for conveying mode II (the second conveying mode), the total time T2 is computed which is the sum total of time A2 that is the product of the number of sheets to be printed of the job to be executed and the unit printing time (i.e., the time A2 is the time obtained by dividing the number of sheets to be printed by the produceability per unit time), and time C2 over which the image drawing drum 170, whose temperature has risen, is cooled after completion of the job.

Next, in step 304, it is judged whether or not the total time T1 of conveying mode I is greater than the total time T2 of conveying mode II. When the total time T1 of conveying mode I is greater than the total time T2 of conveying mode II, in step 306, conveying mode II is selected. Due thereto, the pattern of skip-conveying by skipping one sheet, that conveys the sheets 122 in continuation only to surface A of the image drawing drum 170, is executed.

On the other hand, when it is judged, in step 304, that the total time T1 of conveying mode I is not greater than the total time T2 of conveying mode II (is less than or equal to time T2), in step 308, conveying mode I is selected. Due thereto, the pattern of skipping one sheet, in which the sheets 122 are conveyed in continuation to surface A of the image drawing drum 170, is executed, and thereafter, the surface on which the sheets 122 are conveyed is switched to surface B, and the pattern of skip-conveying by skipping one sheet, in which the sheets 122 are conveyed in continuation, is executed.

In FIG. 8, because the number of sheets to be printed of the job of one time are the same, it suffices to compare the total times (processing times) T1, T2 without comparing the number of sheets processed per unit time in conveying mode I and conveying mode II. Due thereto, the most effective conveying mode can be selected from among conveying mode I and conveying mode II.

Note that FIG. 8 shows a flow of processings that select either conveying mode I or conveying mode II. However, conveying pattern 2 shown in FIG. 4 and FIG. 5 may be made to be "conveying mode III", and the most effective conveying mode may be selected upon comparing total time T3 of "conveying mode III" with aforementioned T1, T2.

In this inkjet recording device 1, any one of plural conveying modes is selected by using, as a reference, a number of sheets processed per unit time that is computed from the product of the number of sheets to be printed of the job to be executed and the unit printing time, and the time needed when switching surface A, on which the sheets 122 are conveyed, of the image drawing drum 170 to surface B during the job, and the time over which the image drawing drum 170, whose temperature has risen, is cooled after completion of the job. Due thereto, even when the sheets 122 (cut papers) are used, cases in which the image processing speed does not keep up with the processing speed of the device (the device speed) can be handled, and skip-conveying (thinned-conveying) can be carried out efficiently. Therefore, blank sheets are not inserted in between sheets on which images are formed.

Further, by computing the lengths (total processing times) of a job in plural conveying modes and selecting the appropriate conveying mode in accordance with the number of sheets processed per unit time, skip-conveying can be carried out more efficiently.

Moreover, as shown in FIG. 6 and FIG. 7, by selecting the optimal conveying mode after predicting, in advance, the extent of the rise in temperature of the surface on which the sheets 122 are not conveyed at the image drawing drum 170, the difference in temperatures between surface A and surface B of the image drawing drum 170 becoming large can be suppressed. Therefore, the effects of heat haze arising such that the waveform of the sensor that senses floating-up of the sheet 122 becomes unstable and erroneous recognition arises, due to the temperatures of the sheets 122 before image formation being different at surface A and surface B, can be suppressed. Further, the temperatures of the sheets 122 on the image drawing drum 170 becoming too high, and condensation arising at the inkjet heads 172M, 172K, 172C, 172Y, can be suppressed.

Further, in conveying mode I and conveying mode II, the sheets 122 are conveyed in continuation to the same surface of the image drawing drum 170. Therefore, dirtying of the peripheral surface of the image drawing drum 170 due to other rollers or the like contacting the surface of the image drawing drum 170 on which the sheets 122 are not conveyed, can be suppressed.

<Image Forming Device of Second Exemplary Embodiment>

A second exemplary embodiment of the image forming device relating to the present invention is described next by using FIG. 9. Note that structural portions that are the same as those of the above-described first exemplary embodiment are denoted by the same numerals, and description thereof is omitted.

Figure 9:
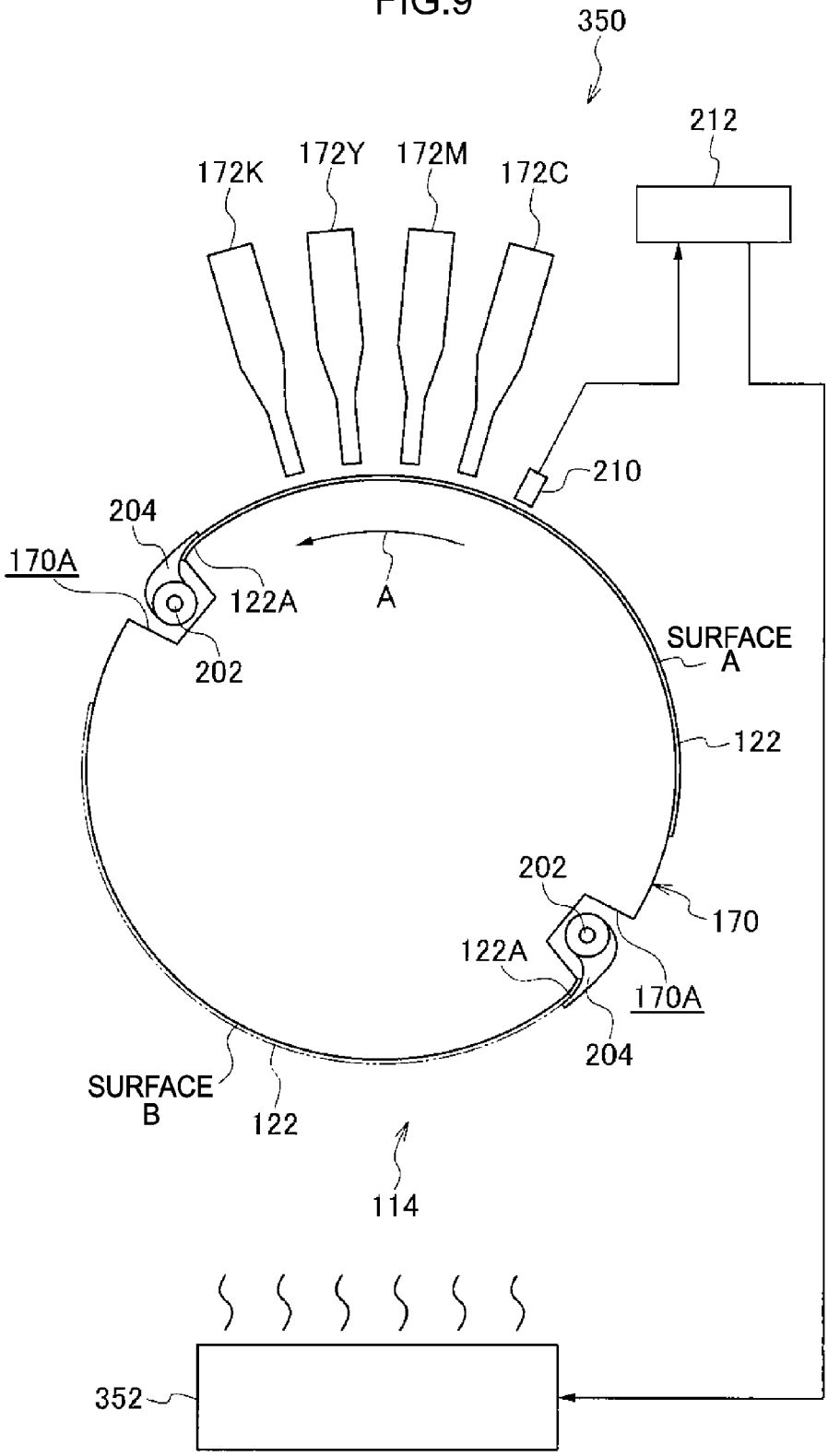
FIG. 9 is a structural drawing showing the image drawing drum and the inkjet heads that are used in an image forming device relating to a second exemplary embodiment of the present invention.

As shown in FIG. 9, in an inkjet recording device 350 that serves as an image forming device of the present exemplary embodiment, a heater is not provided at the interior of the image drawing drum 170 of the image drawing section 114. In the inkjet recording device 350, as shown in FIG. 1, the temperature of the image drawing drum 170 rises due to the heat that is transmitted from the drying section 116, in which the IR heaters 178 and the warm air heater 180 are disposed, and the like. A cooling device 352, that has blow ports, is provided at the lower side of the image drawing drum 170. The image drawing drum 170 is cooled due to cool air being blown-out from the blow ports of the cooling device 352. The on/off state of the cooling device 352, and the temperature and the blown amount of the cool air, are controlled by the control device 212.

In the inkjet recording device 350 of the present exemplary embodiment, the control of the skip-conveying in accordance with plural conveying modes is the same as in the above-described first exemplary embodiment.

In the inkjet recording device 350, the temperature of the image drawing drum 170 rises due to the heat that is transferred from the drying section 116 (see FIG. 1) and the like. However, the image drawing drum 170 is cooled due to cool air being blown-out from the cooling device 352 that is at the lower side of the image drawing drum 170. Due thereto, the temperature of the peripheral surface of the image drawing drum 170 rising excessively can be suppressed. Further, due to the temperature of the image drawing drum 170 rising due to the heat that is transferred from the drying section 116 (see FIG. 1) and the like, there is the possibility that a temperature difference between surface A and surface B of the image drawing drum 170 will arise at the time of carrying out skip-conveying. However, due to the image drawing drum 170 being cooled by the cool air from the cooling device 352, the temperature difference between surface A and surface B of the image drawing drum 170 becoming large can be suppressed.

<Other Points>

Exemplary embodiments of the present invention have been described above, but the present invention is not limited in any way to the above-described embodiments, and can, of course, be implemented by various aspects within a range that does not deviate from the gist of the present invention.

Note that, in the above-described first and second exemplary embodiments, the image drawing drum 170 holds and conveys the two sheets 122 on surface A and surface B. However, the present invention is not limited to the same, and may be structured such that, for example, three sheets are conveyed while being held respectively at holding regions that are obtained by the peripheral surface of the image drawing drum being divided into three sections. For example, the present invention can be structured such that, in a case in which surface A, surface B and surface C on which sheets are held are provided at the peripheral surface of the image drawing drum, there are a first conveying mode that is set such that the sheets are conveyed in the order of surface AAAA . . . (switch) surface BBBB . . . (switch) surface CCCC . . . , and a second conveying mode that is set such that the sheets are conveyed only to surface AAAA . . . .

Further, the number of sheets that are held at the peripheral surface of the image drawing drum may be greater than or equal to three. Moreover, the present invention is not limited to an image drawing drum, and a conveying body formed from a conveying belt may be used.

In addition, although the three conveying modes shown in FIG. 4 and FIG. 5 are illustrated in the above-described first and second exemplary embodiments, the present invention is not limited to the same, and other conveying modes may be further set. Namely, four or more conveying modes may be set, and the most efficient conveying mode may be selected from the number of sheets processed per unit time of the image forming device.

Further, the above first and second exemplary embodiments describe, as an example, an inkjet-type image forming device that uses aqueous inks using water as a solvent. However, the liquid that is ejected is not limited to inks for recording images or printing characters or the like, and any of various types of ejected liquids can be applied provided that they are liquids using a solvent or a dispersion medium that seeps into a recording medium.

What is claimed is:

1. An image forming device comprising:

a conveying body that holds and conveys a plurality of recording media at different holding regions of a peripheral surface of the conveying body respectively;

an image forming section that is provided so as to face the conveying body, and that forms images on surfaces of the recording media that are held at the conveying body; and a control device that has a plurality of conveying modes that are set such that the recording media are thinned-conveyed to a predetermined holding region without using all of the holding regions of the peripheral surface of the conveying body.

2. The image forming device of claim 1, wherein the control device selects any one of the plurality of conveying modes by using, as a reference, a number of recording media processed per unit time that is computed from a product of a number of recording media to be printed of a job to be executed and a unit printing time, and a time required when switching the holding region on which the recording media are conveyed of the peripheral surface of the conveying body during the job, and a time over which the conveying body, whose temperature has risen, is cooled after completion of the job.

3. The image forming device of claim 1, wherein the conveying body holds and conveys two recording media on a first surface and a second surface that serve as the holding regions, and the plurality of conveying modes include:

a first conveying mode in which a pattern of skipping one recording medium that supplies the recording media in continuation to the first surface is executed, and thereafter, a surface on which the recording media are conveyed is switched to the second surface, and a pattern of skipping one recording medium that supplies the recording media in continuation is executed, and a second conveying mode in which only a pattern of skipping one recording medium, that supplies the recording media in continuation to a same one surface among the first surface and the second surface, is executed.

4. The image forming device of claim 3, wherein for the first conveying mode, the control device computes time T1 that is a sum total of time A1 that is the product of the number of recording media to be printed of the job to be executed and the unit printing time, and time B that is needed when switching the holding region on which the recording media are conveyed of the peripheral surface of the conveying body during the job, and time C1 over which the conveying body, whose temperature has risen, is cooled after completion of the job, and for the second conveying mode, the control device computes time T2 that is a sum total of time A2 that is the product of the number of recording media to be printed of the job to be executed and the unit printing time, and time C2 over which the conveying body, whose temperature has risen, is cooled after completion of the job, and when T1>T2, the control device executes the second conveying mode.

5. The image forming device of claim 1, wherein the image forming section is a droplet ejecting device that ejects droplets onto a surface of a recording medium.

6. The image forming device of claim 1, further comprising a feed-out device that feeds out a recording medium from a stacking section in which a plurality of the recording media are stacked, wherein the control device executes the plurality of conveying modes by controlling a feed-out timing of the recording medium that is fed-out from the feed-out device.

7. An image forming method comprising:

providing a plurality of conveying modes that are set such that recording media are thinned-conveyed to a predetermined holding region without using all holding regions of a peripheral surface of a conveying body that holds and conveys a plurality of the recording media at different holding regions of the peripheral surface of the conveying body respectively;

selecting any one of the plurality of conveying modes on the basis of a number of recording media processed per unit time;

on the basis of the selected conveying mode, conveying the recording media to a predetermined holding region of the peripheral surface of the conveying body at a predetermined timing; and forming images on surfaces of the recording media.

8. The image forming method of claim 7, wherein any one of the plurality of conveying modes is selected by using, as a reference, the number of recording media processed per unit time that is computed from a product of a number of recording media to be printed of a job to be executed and a unit printing time, and a time required when switching the holding region on which the recording media are conveyed of the peripheral surface of the conveying body during the job, and a time over which the conveying body, whose temperature has risen, is cooled after completion of the job.

9. The image forming method of claim 7, wherein the conveying body holds and conveys two recording media on a first surface and a second surface that serve as the holding regions, and the plurality of conveying modes include:

a first conveying mode in which a pattern of skipping one recording medium that supplies the recording media in continuation to the first surface and forms images on the recording media, is executed, and thereafter, a surface on which the recording media are conveyed is switched to the second surface, and a pattern of skipping one recording medium that supplies the recording media in continuation and forms images on the recording media is executed, and a second conveying mode in which only a pattern of skipping one recording medium, that supplies the recording media in continuation to a same one surface among the first surface and the second surface and forms images on the recording media, is executed.

10. The image forming method of claim 9, wherein, for the first conveying mode, time T1 is computed that is a sum total of time A1 that is the product of the number of recording media to be printed of the job to be executed and the unit printing time, and time B that is needed when switching the holding region on which the recording media are conveyed of the peripheral surface of the conveying body during the job, and time C1 over which the conveying body, whose temperature has risen, is cooled after completion of the job, and for the second conveying mode, time T2 is computed that is a sum total of time A2 that is the product of the number of recording media to be printed of the job to be executed and the unit printing time, and time C2 over which the conveying body, whose temperature has risen, is cooled after completion of the job, and when T1>T2, the second conveying mode is executed, and at other times, the first conveying mode is executed.

* * * * *